United States Patent [19]

Carles et al.

[11] 4,274,912

[45] Jun. 23, 1981

[54] PROCESS FOR BLEACHING PREOXIDIZED PAPER PULP

[75] Inventors: Jacques E. Carles; Michel Durand, both of Saint Gaudens, France

[73] Assignee: Groupement Europeen de la Cellulose, Paris, France

[21] Appl. No.: 59,256

[22] Filed: Jul. 19, 1979

[30] Foreign Application Priority Data

Aug. 1, 1978 [FR] France ..... 78 22719

[51] Int. Cl.[3] ..... D21C 9/12

[52] U.S. Cl. ..... 162/41; 162/60; 162/65; 162/66; 162/67; 162/72; 162/78; 162/88; 162/89

[58] Field of Search ..... 162/41, 60, 66, 67, 162/72, 73, 78, 88, 89, 65

[56] References Cited

U.S. PATENT DOCUMENTS

| | | | |
|---|---|---|---|
| 2,478,379 | 8/1949 | Dodson | 162/73 |
| 3,884,752 | 5/1975 | Campbell et al. | 162/89 |
| 4,039,372 | 8/1977 | Reeve et al. | 162/89 |
| 4,093,506 | 6/1978 | Richter | 162/88 |

FOREIGN PATENT DOCUMENTS

| | | | |
|---|---|---|---|
| 547539 | 10/1957 | Canada | 162/89 |
| 612417 | 1/1961 | Canada | 162/88 |

OTHER PUBLICATIONS

Aldrich, *Cellulose Degradation Inhibitors for the Chlorination Stage,* Tappi, vol. 51, No. 3, (Mar. 1968), pp. 71–74.

*Primary Examiner*—Peter Chin

*Attorney, Agent, or Firm*—Shenier & O'Connor

[57] ABSTRACT

The invention relates to a process for bleaching preoxidized paper pulp enabling a pulp having a very high degree of whiteness to be obtained with a limited number of treatment steps and enabling pollution to be reduced without degrading the qualities of the pulp; such a process essentially comprises the combination of the three successive treatment steps, namely:

(a) a first step of hot chlorination with gaseous chlorine at a temperature of between about 30° and 80° C., and preferably between 35° and 50° C., in the presence of urea used at a rate of 0.5 to 5% by weight of the chlorine used, and preferably from 1 to 3%, with a concentration of pulp of between 3 and 30%, and a duration of retention of the chlorine of 30 seconds to 45 minutes;

(b) a second step of alkaline extraction in the presence of an oxidizing agent of the hypochlorite or peroxide type, at a temperature of between about 30° and 70° C., and at a pH of between about 8 and 12, and preferably between 10.5 and 11.5, and (c) a third step of treatment with chlorine dioxide, at a temperature of between 60° and 90° C. and preferably between 70° and 80° C., at an initial pH of between 5 and 11, and preferably between 7 and 9, a recycling of the effluents of the second and/or the third treatment step for intermediate washing preceding the corresponding step being provided.

12 Claims, 1 Drawing Figure

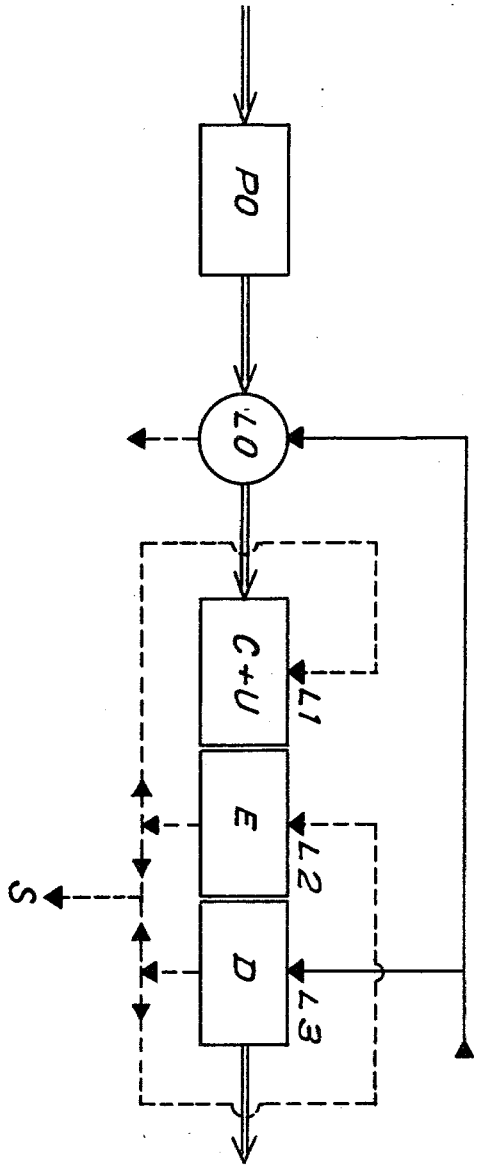
PO
10
C+U
11
E
12
D
13
S

PROCESS FOR BLEACHING PREOXIDIZED PAPER PULP

The present invention relates to a process for bleaching paper pulp.

The manufacture of bleached paper pulp comprises a first step of baking a ligno-cellulosic material, with the aid of chemical reagents intended for dissolving the greater part of the lignin and for freeing the fibres of the cellulose, and a second step consisting in eliminating the remaining lignin and in bleaching the fibres obtained by baking, this second step being effected in several phases with the aid of various reagents: chlorine, sodium hydroxide, chlorine dioxide, hypochlorite . . . .

The residual liquors from the first step of baking may be recovered and burnt. On the other hand, the effluents coming from the second step generally cannot be recovered due to the presence of corrosive chlorides. The rejection of these effluents constitutes an important source of pollution.

To reduce this pollution, it has been proposed to effect a preoxidation of the unbleached pulp, which preoxidation is effected in an alkaline medium with the aid of hyrdogen peroxide or oxygen under pressure. This preoxidation completes the delignification made in the course of the baking step by an oxidising delignification which produces an effluent which may be recovered and burnt. In addition, the preoxidation enables the number of phases of the second bleaching step to be reduced and therefore the quantity of pollutant effluents which may be produced, to be reduced.

However, to manufacture a paper pulp with a very high degree of whiteness (I S O degree of whiteness>88), a bleaching in five phases is generally conserved, after preoxidation of the pulp, said phases symbolised by C E D E D (C: chlorination, E: alkaline extraction, D: treatment with chlorine dioxide.

It is an object of the present invention to provide a process for bleaching preoxidised paper pulp enabling a pulp with a very high degree of whiteness to be obtained with a number of steps of bleaching the preoxidised pulp limited to three, enabling a substantial saving of reagents to be made and considerably reducing the pollution produced by the effluents, without degrading the qualities of the pulp.

This object is attained due to a process which essentially comprises the combination of three successive steps of treatment, namely:

(a) a first step of hot chlorination with gaseous chlorine, at a temperature of between about 30° and 80° C., and preferably between 35° and 50° C., in the presence of urea used at a rate of 0.5 to 5% by weight of the chlorine used, and preferably from 1 to 3%, with a concentration of pulp of between 3 and 30%, and a duration of retention of the chlorine of 30 seconds to 45 minutes;

(b) a second step of alkaline extraction in the presence of an oxidising agent of the hypochlorite or peroxide type, at a temperature of between about 30° and 70° C., and at a pH of between about 8 and 12, and preferably between 10.5 and 11.5, and (c) a third step of treatment with chlorine dioxide, at a temperature of between 60° and 90° C. and preferably between 70° and 80° C., at an initial pH of between 5 and 11, and preferably between 7 and 9, a recycling of the effluents of the second and/or the third treatment step for intermediate washing preceding the corresponding step being provided.

The first step is effected at a temperature of between 30° ad 80° C., and preferably between 35° and 50° C. The urea added to the pulp during the first chlorination step acts as protector to avoid degradations of the pulp resulting from the hot chlorination.

The quantity of urea used during the first step represents, in weight, about 0.5 and 5%, and preferably 1 to 3% of the chlorine used in the course of this first phase. The urea is added to the pulp before, during or after the introduction of the chlorine.

The chlorine is introduced in the form of gaseous chlorine and chlorination is effected on a paper pulp at a concentration of between 3 and 30%.

When chlorination is effected at high concentration (for example 10%), the injection of the gaseous chlorine corresponds to a short duration of retention, for example of between 30 seconds and 5 minutes. When chlorination is effected at low concentration (for example 3.5%), the retention time may be increased up to 15–45 minutes).

The chlorination effected on a pulp at low concentration, is, however, translated by the necessity of diluting the pulp before bleaching and therefore, upon thickening, by the necessity of rejecting a large amount of effluent. p The first step is preferably effected on a pulp at high concentration, i.e. about 8 to 15% and preferably 9 to 11%. The three-step treatment according to the invention makes it possible, in fact, to operate without prior dilution, this finally being translated by a considerable reduction in the quantity of effluents rejected.

The first chlorination step is followed, after an intermediate washing of the pulp, by a second step consisting in an alkaline extraction in the presence of an oxidising agent such as a hypochlorite or a peroxide.

To conserve excellent properties in a pulp which is preoxidised then chlorinated, it is desirable to effect the alkaline extraction step at a temperature of between about 30° and 70° C., and at a pH of between about 8 and 12, and preferably between 10.5 and 11.5.

According to an advantageous feature of the process according to the invention, at least a part of the alkaline effluent from the second step is recycled, in order to neutralise the pulp having undergone the first bleaching step, in the course of the intermediate washing following this first step.

This recycling allows a reduction in the quantity of outside alkali necessary for controlling the pH during the second step and a reduction in the quantity of effluent rejected.

In addition, it is possible to recycle, the excess effluent from the second step, particularly when it is effected in the presence of a peroxide, for washing the unbleached pulp. This excess effluent may then be recovered and burnt with the residual liquor from baking.

In the case of the second alkaline extraction step being effected on the pulp in the presence of hypochlorite, urea serving as protector may be added to the pulp.

The quantity of urea added during the second step then represents 1 to 10%, and preferably 2 to 5% of the chlorine used in the form of hypochlorite during this second step.

The third and last step of bleaching consists in a treatment with chlorine dioxide.

This latter step is effected at a relatively high temperature i.e. of between about 60° and 90° C., and preferably between 70° and 80° C. and at an initial pH of between about 5 and 11, and preferably between 7 and 9.

This initial pH is advantageously controlled by recycling at least a part of the effluent of the third step.

This acid effluent is used for reducing the residual alkali of the second step in the course of the intermediate washing of the pulp obtained after this second step.

There again, the recycling of the effluent from the third step allows a reduction in the quantity of effluent finally rejected.

The single FIGURE of the accompanying drawings schematically illustrates by way of indication and in non-limiting manner, a particular embodiment of the bleaching process according to the invention.

After having undergone, in P 0, a preoxidation with oxygen under pressure of hydrogen peroxide, the pulp, (of which the path is shown diagrammatically by a double line) is washed in L 0 in water then undergoes the three steps of the process according to the invention, namely:

chlorination in the presence of urea (C+U), followed by a washing L 1, alkaline extraction (E) in the presence of an oxidising agent followed by a washing L 2, and, treatment with chlorine dioxide (D) followed by a washing L 3.

Washing water (of which the path is diagrammatically shown by a single solid line) is used for washing L 0 and L 3.

At least a part of the effluent of the third step is used for washing L 2 and at least part of the effluent of the second step is used for washing L 1 (the path of the effluents is diagrammatically shown by broken lines). The excess of the effluents is rejected at S.

It is therefore possible to effect, during the bleaching of the preoxidised pulp, a washing in direct counter-current with respect to the path of the pulp. This makes it possible to reduce the quantity of effluent finally rejected by about 85% with respect to the conventional bleaching without recycling of effluents. A considerable reduction in pollution may therefore be obtained.

In addition, as only the last step of bleaching is effected at relatively high temperature, the total consumption of energy necessary is therefore restricted.

Non-limiting examples of applications of the process according to the invention are given hereinafter.

EXAMPLE 1

A hardwood Kraft pulp (mixture of beech, oak and diverse) prebleached with oxygen and of which the Kappa index is 11.2 is subjected to a bleaching in three steps, according to the invention.

Different tests are made, varying the concentration of the pulp, the temperature during the chlorination step and the oxidising agent used in the course of the alkaline extraction step.

The results of the tests are grouped in Table I hereinbelow. By way of comparison, measures have been made on a bleached pulp without addition of urea during the chlorination step.

TABLE I

| | | | | | | | | | |
|---|---|---|---|---|---|---|---|---|---|
| Concentration of the pulp % | | 3.5 | | 9 | | | | 3.5 | |
| 1st step | $Cl_2$ % | 3.6 | | 3.6 | | 3.8 | | 3.6 | |
| | Urea % | 0.1 | | 0.1 | | 0.1 | | 0 | |
| | T (°C.) | 40 | | 40 | | 60 | | 40 | |
| | Rentention (mins). | 30 | | <5 | | <5 | | 30 | |
| 2nd step | hypochlorite | 1.5 | 0 | 1.5 | 0 | 1.6 | 0 | 1.5 | 0 |
| alkaline extraction | Peroxide % | 0 | 0.8 | 0 | 0.8 | 0 | 0.8 | 0 | 0.8 |
| | NaOH % | 0.9 | 0.9 | 0.9 | 0.9 | 0.9 | 0.9 | 0.9 | 0.9 |
| duration: 1 hr. | T (°C.) | 45 | 60 | 45 | 60 | 40 | 60 | 45 | 60 |
| 3rd Step | $ClO_2$ % | 0.8 | | 0.8 | | | | 0.8 | |
| duration: 3 hrs. | T (°C.) | 80 | | 80 | | | | 80 | |
| ISO degree of whiteness | | 89.0 | 88.2 | 88.6 | 88.0 | 88.8 | 88.5 | 89.5 | 89.1 |
| Degree of polymerisation | | 810 | 900 | 770 | 920 | 835 | 870 | 675 | 680 |
| Yield % | | 96.9 | 97.1 | 96.5 | 97.7 | 96.1 | 96.5 | 96.3 | 96.5 |

The quantities by weight of reagents used during the three steps are expressed in percentage of the weight of the pulp. The quantities for the hypochlorite correspond to the percentage of active chlorine. The duration of retention of the chlorine during the first step is expressed in minutes.

It is observed that the absence of urea during the chlorination leads to a strong degradation of the cellulose (degree of polymerisation close to 680). On the contrary, small quantities of urea allow a good quality of pulp to be maintained even when the chlorination is effected at high temperature (60° C.). This result is, moreover, obtained at low cost, as urea is an inexpensive protector.

EXAMPLE 2

This example shows the role that the urea may perform in the course of the alkaline step in the presence of hypochlorite.

The preoxidised pulp of Example 1 has been subjected to a low concentration chlorination, under the conditions indicated in preceding Table I.

The chlorinated pulp is subjected to an alkaline extraction step in the presence of hypochlorite then to the final step of treatment with chlorine dioxide. Two tests are made respectively with and without the addition of urea to the second step. The results figure in Table II hereinafter.

TABLE II

| | | | |
|---|---|---|---|
| 2nd step | Urea (%) | 0.1 | 0 |
| duration: 1 hr. | hypochlorite (%) expressed as active $Cl_2$ | 1.8 | 1.8 |
| temperature 50° C. | NaOH % | 1.2 | 1.2 |

TABLE II-continued

| | | | |
|---|---|---|---|
| 3rd step duration: 3 hrs. | $ClO_2$ (%) | 0.9 | 0.9 |
| | ISO degree of whiteness | 88.3 | 88.8 |
| | Degree of polymerisation | 840 | 795 |

EXAMPLE 3

A softwood Kraft pulp preoxidised with oxygen under pressure and of which the Kappa index is 17.1 is bleached according to the conventional process CEDED and according to the process of the invention with five possible variants:

$C_uPD$, $C_uHD$, $C_uH_uD$, $C_u$*PD and $C_u$*$H_uD$;

$C_u$ designates chlorination in the presence of urea,

P alkaline extraction in the presence of peroxide,

H alkaline extraction in the presence of hypochlorite, $H_u$ alkaline extraction in the presence of hypochlorite and urea, $C_u$* chlorination in the presence of urea on a pulp at high concentration.

The results mentioned in Table III hereinbelow demonstrate the fact that the combination of the three steps according to the invention leads to an overall result superior to that obtained in five conventional steps, particularly concerning:

the high degree of whiteness the yield and resistance of the cellulose produced (degree of polymerisation: D.P.)

pollution and in particular the colour costs:

(1) substantial reduction in the costs of reagent (reduction in the quantities of expensive reagents—chlorine dioxide—in favour of inexpensive reagents—chlorine, urea);

(2) substantial reduction in thermal energy: only the last step D must be heated since the pulp issuing from a preoxidation is generally at the temperature of treatment of the first two phases (3) reduction of the number of steps (reduction in investments).

TABLE III

| | | CEDED reference | $C_uPD$ | $C_uHD$ | $C_uH_uD$ | $C_u$*PD | $C_u$*$H_uD$ |
|---|---|---|---|---|---|---|---|
| C | Conc. pulp % | 3.5 | 3.5 | 3.5 | 3.5 | 10 | 10 |
| | T°C. | 25 | 40 | 40 | 40 | 40 | 40 |
| | t (mins.) | 25 | 30 | 30 | 30 | 5 | 5 |
| | % $Cl_2$ introduced | 3.8 | 4.2 | 4.2 | 4.2 | 4.2 | 4.2 |
| | % urea | 0 | 0.1 | 0.1 | 0.1 | 0.1 | 0.1 |
| | % remaining $Cl_2$ | 0.49 | 0.42 | 0.40 | 0.39 | 0.48 | 0.48 |
| | pH | 2.1 | 2.0 | 2.0 | 2.1 | 2.0 | 2.0 |
| E, | P or H | | | | | | |
| | T°C. | 50 | 60 | 45 | 45 | 60 | 40 |
| | t (mins.) | 60 | 120 | 120 | 120 | 120 | 120 |
| | % hypochlorite (in $Cl_2$) | — | — | 1.7 | 1.7 | — | 1.7 |
| | % NaOH | 1.2 | 1.6 | 1.7 | 1.6 | 1.6 | 1.6 |
| | % $H_2O_2$ | — | 0.8 | — | — | 0.8 | — |
| | % residues | — | 0.04 | 0.024 | 0.03 | 0.019 | 0.02 |
| | pH | 11.4 | 10.6 | 11.6 | 11.7 | 10.5 | 11.6 |
| D | initial pH | — | 8.0 | 8.0 | 8.0 | 8.0 | 8.0 |
| | T°C. | 70 | 80 | 80 | 80 | 80 | 80 |
| | t (mins.) | 150 | 240 | 240 | 240 | 240 | 240 |
| | % $ClO_2$ introduced | 1.2 | 0.9 | 0.9 | 0.9 | 0.9 | 0.9 |
| | % remaining $Cl_2$ | 0.12 | 0.14 | 0.16 | 0.15 | 1.09 | 0.07 |
| | final pH | 2.8 | 2.5 | 2.5 | 2.6 | 2.5 | 2.6 |
| E | T°C. | 50 | | | | | |
| | t (mins.) | 60 | | | | | |
| | % NaOH | 0.6 | | | | | |
| | pH | 11.5 | | | | | |
| D | T°C. | 80 | | | | | |
| | t (mins.) | 180 | | | | | |
| | % $ClO_2$ introduced | 0.6 | | | | | |
| | % remaining $Cl_2$ | 0.12 | | | | | |
| | pH | 2.8 | | | | | |
| ISO degree of whiteness | | 90.6 | 91.8 | 91.8 | 91.2 | 91.4 | 90.9 |
| Yield % | | 96.8 | 97.2 | 97 | 97.2 | 97 | 97.3 |
| D.P. (degree of polymerisation | | 980 | 1035 | 1020 | 1110 | 1060 | 1110 |
| Colour (1) kg Pt465nm/tpbAD | | 98 | 62 | 41.4 | 43.2 | 52.2 | 48.6 |
| BOD (2) kg$^5O_2$/tpbAD | | 16.2 | 10.8 | 10.5 | — | 9.5 | — |
| Price index | | 100 | 91 | 86 | 87 | 92 | 87 |

(1) kg of platinum per ton of bleached pulp dried in air
(2) Biological oxygen demand

EXAMPLE 4

A hardwood Kraft pulp prebleached with oxygen and of which the Kappa index is 11 is bleached in three steps CHD under the following conditions:

| | |
|---|---|
| 1st step (C) = | T° = 40° C.; duration: 5 mins., concentration pulp: 10%<br>% $Cl_2$/pulp = 3.6 |
| 2nd step (H) = | T°: 45° C.; duration: 60 mins., concentration pulp: 10%<br>% hypochlorite/pulp: 1.5<br>% NaOH/pulp: 0.9<br>pH: 11.0 |
| 3rd Step (D) = | T° = 80° C.; duration: 180 mins., concentration pulp: 10%<br>initial pH = 8 |

-continued

| % $ClO_2$/pulp = 0.9 |
|---|

Four steps are carried out under these conditions with and without urea in the first and second steps;

TABLE IV

| Test N° | 1 (CHD) | 2 ($CH_uD$) | 3 ($C_uHD$) | 4 ($C_uH_uD$) |
|---|---|---|---|---|
| | no urea | 0.1% urea at the 2nd step (H) | 0.1% urea at the 1st step (C) | 0.1% urea at the 1st and 2nd steps (C and H) |
| Whiteness | 89.0 | 89.0 | 89.0 | 89.0 |
| D.P. | 680 | 700 | 750 | 860 |

The quality of the pulps produced (degree of polymerisation) is improved by the introduction of urea. This effect becomes spectacular for test 4 where the urea is added both at the first and at the second steps; with respect to tests 2 and 3, it is observed that this test is synergetic (and non-additive).

$$C_uH_uD > C_uHD > CH_uD > CHD$$

EXAMPLE 5

A hardwood Kraft pulp of which the Kappa index is 22 is bleached in three steps CHD and without preoxidation with oxygen:

TABLE V

| | Test 1 Pretreatment $O_2$ T = 115° C. t = 30 mins. % NaOH = 1.5 Pressure $O_2$ = 6 bars | Test 2 without preoxidation of the pulp |
|---|---|---|
| C (40° C., 30 (mins.) | | |
| % $Cl_2$ introduced | 3.5 | 5.4 |
| % remaining $Cl_2$ | 0.5 | 0.5 |
| % urea | 0.1 | 0.1 |
| H (45° C., 60 mins.) | | |
| % hypochlorite | 1.5 | 1.8 |
| % NaOH | 0.9 | 1.2 |
| % urea | 0.1 | 0.1 |
| D (80° C., 180 mins.) | | |
| % $ClO_2$ | 0.9 | 1.2 |
| Degree of whiteness | 89.5 | 81.0 |

It is observed that the bleaching in three steps applied to a non-preoxidised pulp cannot be bleached to a sufficient degree of whiteness.

What is claimed is:

1. A process for bleaching an oxygen or peroxide preoxidized paper pulp to produce a pulp having a very high degree of whiteness with a limited number of treatment steps while reducing pollution without degrading the qualities of the pulp comprising essentially the combination of three successive treatment steps, namely:

(a) a first step of hot chlorination with gaseous chlorine, at a temperature of between about 30° and 80° in the presence of urea in an amount between about 0.5 to 5% by weight of the chlorine used, with a concentration of pulp between 3 and 30%, and a duration of retention of the chlorine of 30 seconds to 45 minutes;

(b) a second step of alkaline extraction in the presence of an oxidizing agent of the hypochlorite type, and in the presence of urea in an amount between about 1 to 10% by weight of the chlorine in the form of hypochlorite, at a temperature of between about 30° and 70° C. and a pH of between about 8 and 12; and (c) a third step of treatment with chlorine dioxide, at a temperature of between about 60° and 90° C. at an initial pH of between about 5 and 11, and recycling effluent of at least one of second and third treatment steps for intermediate washing preceding the corresponding stcp.

2. The process as in claim 1 wherein the concentration of pulp in the first chlorination step is between about 8 and 15% and the duration of retention of the chlorine is about 30 seconds to 5 minutes.

3. The process as in claim 1 wherein effluent from the second bleaching step is recycled in order to neutralize the pulp issuing from the first step of bleaching.

4. The process as in claim 1 wherein effluent from the third step of bleaching is recycled for washing the pulp issuing from the second step to control the initial pH of the third step.

5. The process as in claim 1 in which said first step is carried out at a temperature between about 35° and 50° C.

6. The process as in claim 1 in which the amount of said urea in the first step is between about 1 to 3%.

7. The process as in claim 1 in which said second step is carried out at a pH of about 10.5 to 11.5.

8. The process as in claim 1 in which said third step is carried out at a pH between 7 and 9.

9. The process as in claim 1 in which said first step is carried out at a temperature of about 35° to 50° C. and in which the amount of urea in said first step is about 1 to 3% of the amount of chlorine used.

10. The process as in claim 1 in which said second step is carried out at a pH between about 10.5 and 11.5 and in which said third step is carried out at a pH between about 7 and 9.

11. The process as in claim 1 in which said third step is carried out at a temperature of about 70° to 80° C.

12. The process as in claim 2 in which said first chlorination step, the concentration of the pulp is between 9 and 11%.

* * * * *

UNITED STATES PATENT AND TRADEMARK OFFICE

CERTIFICATE OF CORRECTION

PATENT NO. : 4,274,912

DATED : June 23, 1981

INVENTOR(S) : Jacques E. Carles and Michel Durand

It is certified that error appears in the above-identified patent and that said Letters Patent are hereby corrected as shown below:

Column 8, line 4, after "80°" insert -- C. --.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*